United States Patent [19]

Masoncup et al.

[11] Patent Number: 4,556,872

[45] Date of Patent: Dec. 3, 1985

[54] PADLOCK WITH TAMPER ALARM

[75] Inventors: John F. Masoncup, 610 N. Maple Ct., Mount Prospect, Ill. 60056; Eric O. Peterson, Elgin; Alan G. Peterson, Oak Park, both of Ill.

[73] Assignee: John F. Masoncup, Mount Prospect, Ill.

[21] Appl. No.: 524,152

[22] Filed: Aug. 18, 1983

[51] Int. Cl.[4] ..... E05B 45/06

[52] U.S. Cl. ..... 340/542; 70/439

[58] Field of Search ..... 340/542, 543, 568; 200/61.64; 70/432, 434, 439, 53

[56] References Cited

U.S. PATENT DOCUMENTS

| | | | |
|---|---|---|---|
| 3,755,778 | 8/1973 | Kennedy et al. | 340/65 |
| 3,824,540 | 4/1974 | Smith, II | 340/63 |
| 3,879,721 | 4/1975 | Yereance | 70/441 |
| 3,993,987 | 11/1976 | Stevens | 340/542 |
| 4,092,641 | 5/1978 | Bellinghausen et al. | 340/628 X |
| 4,151,506 | 4/1979 | Schoenmetz | 340/63 |

*Primary Examiner*—James L. Rowland
*Assistant Examiner*—Jeffery A. Hofsass
*Attorney, Agent, or Firm*—Marshall, O'Toole, Gerstein, Murray & Bicknell

[57] ABSTRACT

A padlock contains a battery connected by electrical circuitry and switches to an alarm sounding device which sounds an alarm when someone attempts to force open or sever the lock shackle or when someone attempts to remove the battery in an unauthorized manner. A test signal of momentary duration is automatically sounded each time the lock is opened or closed in an authorized manner, and this indicates whether the alarm system is operative.

36 Claims, 8 Drawing Figures

PADLOCK WITH TAMPER ALARM

BACKGROUND OF THE INVENTION

The present invention relates generally to locks and more particularly to a padlock with an alarm which sounds when someone tries to violate or tamper with the padlock.

Generally, a padlock comprises a body and a shackle having a pair of legs. The shackle is mounted for reciprocal movement relative to the body between a closed first position and an open second position. Located within the body is a latch for engaging one leg of the shackle when the shackle is in its closed position, and this prevents movement of the shackle to its open position. In order to move the shackle from its closed to its open position, the latch must be disengaged, and the padlock includes a lock mechanism operable to disengage the latch. The lock mechanism may be key operated or combination-operated in an authorized manner. The padlock is typically composed of a hard metal such as steel.

Padlocks are used for securing possessions or property to prevent theft or trespassing. It is not uncommon, however, for someone intent on theft or trespassing to tamper with the padlock in an attempt to open it in an unauthorized manner, either by severing the shackle or by forcing it into an open position. To deter a thief or the like from tampering with the padlock, it has been proposed to provide the padlock with an integral alarm system which sounds an alarm when the thief violates or tampers with the padlock. A padlock having an integral alarm system is disclosed in Stevens, U.S. Pat. No. 3,993,987. Such a system conventionally includes, in addition to the alarm sounding device, a battery for energizing the alarm sounding device and an electrical circuit and switches connecting the alarm sounding device to the battery and causing the alarm sounding device to operate when a violation occurs or an attempt is made to tamper with the padlock.

Because such an alarm system is powered by a battery, and because a battery can wear out, it is desirable to be able to test the battery to determine whether it still has sufficient power to operate the alarm. Provision for testing the battery is made in the system disclosed in the above-noted Stevens patent, but the test is complicated. First the lock mechanism must be opened with a key to open the shackle and then the lock mechanism must be closed with a key while the shackle is in its open position. Moreover, to shut off an alarm undergoing testing, either the lock mechanism must then be opened with a key or the shackle must be closed. No provision is made for automatic testing of the alarm so that, should one forget to proceed through the manipulative steps required in order to test the battery in the Stevens system, the battery could wear out without one knowing it. Furthermore, if the shackle is opened with a key, and the key is then removed, the Stevens alarm will sound, which is bothersome and otherwise undesirable.

Moreover, because all batteries eventually wear out and must be replaced, access must be provided to the battery within the padlock to permit removal and replacement of the battery. Such a provision, however, gives a thief the opportunity to gain access to the battery to remove it and deactivate the alarm. In Stevens there is no provision for sounding the alarm when a thief gains access to the battery.

SUMMARY OF THE INVENTION

The present invention constitutes a padlock with a tamper alarm which overcomes the deficiencies of the prior art described above. In accordance with the present invention, each time the shackle is moved between its open and closed positions in an authorized manner, the alarm is actuated momentarily, giving a short test beep or sound. Thus, the alarm and the battery are tested automatically each time the shackle is opened or closed in an authorized manner, and one need not remember intentionally to test the alarm to determine if it is still operative. In addition, a padlock in accordance with the present invention comprises structure for actuating the alarm whenever an attempt is made to remove the battery without first unlocking the shackle in an authorized manner. This structure effectively thwarts a thief who has gained access to the battery in an attempt to remove it.

In addition to the features described above, the padlock of the present invention comprises structure for actuating the alarm when an attempt is made forcibly to raise or to sever the shackle.

Other features and advantages are inherent in the structure claimed and disclosed or will become apparent to those skilled in the art from the following detailed description in conjunction with the accompanying diagrammatic drawing.

DETAILED DESCRIPTION

Figures 1, 7, 8:
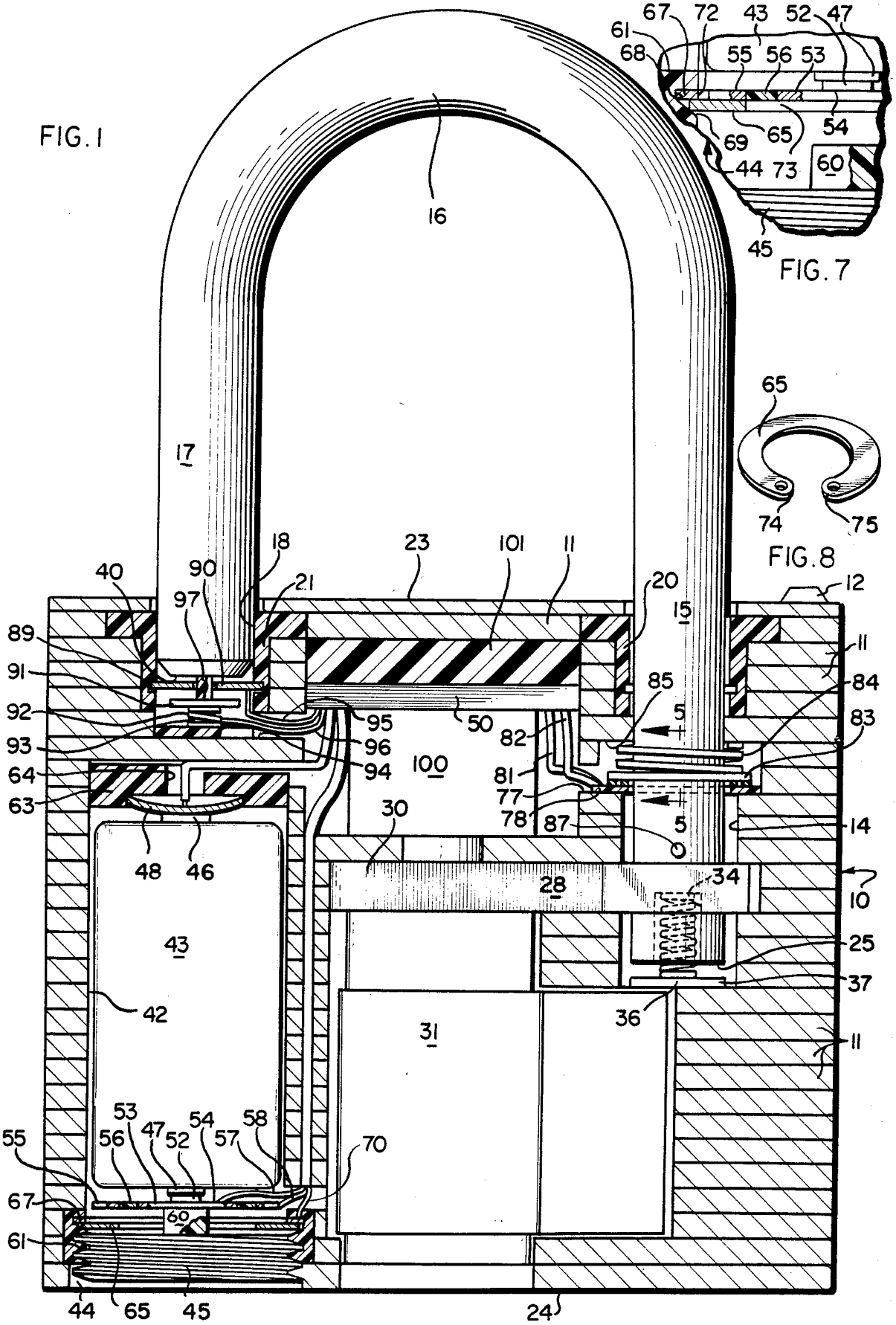
FIG. 1 is a side elevation, in section, of a padlock with a tamper alarm in accordance with an embodiment of the present invention.
FIG. 7 is a fragmentary sectional view illustrating a part of the alarm system which operates when an attempt is made to remove the battery from the padlock without authorization.
FIG. 8 is a plan view of a C-shaped ring employed in that part of the apparatus shown in FIG. 7.
Figure 2:
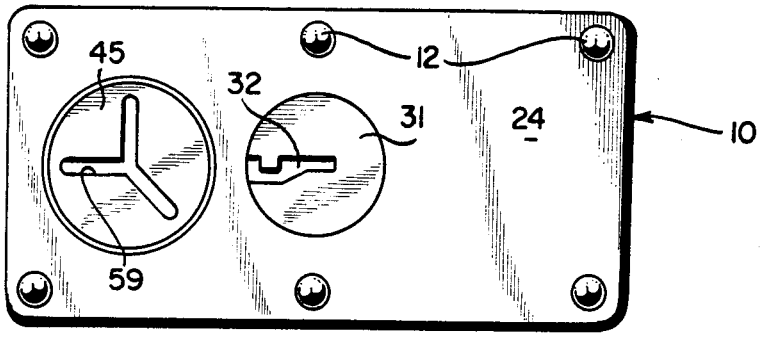
FIG. 2 is a bottom view of the padlock of FIG. 1.

Referring initially to FIGS. 1 and 2, indicated generally at 10 is a padlock body composed of a series of laminations 11, 11 held together by rivets 12, 12. Padlock body 10 has a pair of opposite ends 23, 24. Extending inwardly from body end 23 is an elongated channel 14 within which is normally located the long leg 15 of a shackle 16 having a short leg 17 which, when the shackle is in a locked position, is received within a channel 18 extending inwardly into padlock body 10 from end 23. Lining the outer portions of channels 14 and 18, respectively, are sleeves 20 and 21, both composed of electrically insulative material.

Shackle 16 is mounted for reciprocal movement relative to body 10 between a closed first position (FIG. 1), in which both shackle legs 15, 17 are received within their respective channels 14, 18 and an open position in which shackle short leg 17 is totally outside of its channel 18. Shackle long leg 15 remains within its channel 14 when the shackle is in an open position. However, long leg 15 does not extend as far inwardly into channel 14, when the shackle is in its open position, as long leg 15 does when the shackle is in its closed position illustrated in FIG. 1.

Figure 3:
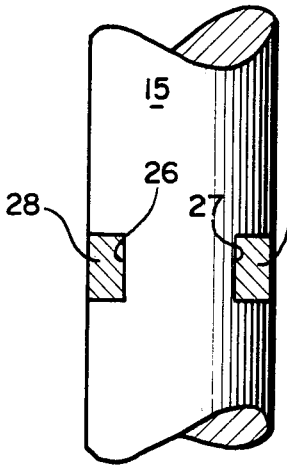
FIG. 3 is a fragmentary view, partially in section, of one shackle leg for the padlock.
Figure 4:
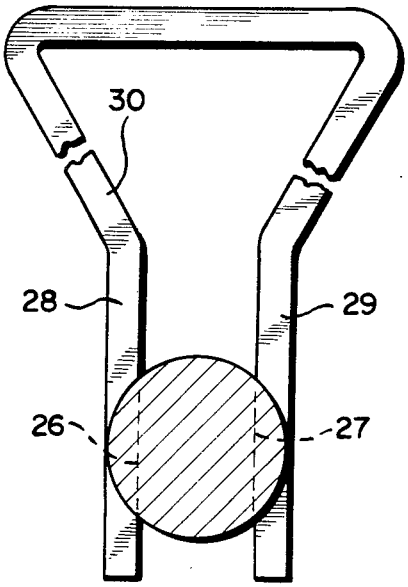
FIG. 4 is a fragmentary view, partially in section, illustrating a latch for the shackle leg.

Located near the end 25 of shackle long leg 15, on opposite sides of long leg 15, are a pair of notches 26, 27 each for receiving a respective arm 28, 29 of a latch 30 (FIGS. 3 and 4).

Located adjacent latch 30 is a lock mechanism 31 operated by a key insertable into a key slot 32 located at end 24 of body 10 (FIG. 2). Lock mechanism 31 is of conventional construction normally found in padlocks and need not be described here. When lock mechanism 31 is operated by turning a key in slot 32, arms 28, 29 on latch 30 are spread apart to withdraw the arms from notches 26, 27 in long leg 15. The structure which spreads apart latch arms 28, 29 in response to the operation of lock mechanism 31 is conventional in nature and need not be described here. Structure of this nature is disclosed in Foote, U.S. Pat. No. 3,423,969 and the disclosure therein of such structure is incorporated herein by reference.

When latch 30 is disengaged from long shackle leg 15, the shackle is urged outwardly to its open position by structure now to be described. Located at end 25 of long leg 15 is a recess 34 within which is received a coil spring 35 mounted on a spring guide 36 located at the inner end 37 of channel 14. When shackle 16 is in the closed position indicated in FIG. 1, spring 35 normally urges shackle 16 towards its open position, but such movement is restrained by the engagement of long leg 15 with latch 30. Upon disengagement of latch 30 from long leg 15, coil spring 35 pushes shackle 16 to its open position. In that position, shackle short leg 17 is totally removed from within channel 18, and the free end 40 of short leg 17 is located totally outside of padlock body 10.

Located within body 10 is an alarm system which will now be described. Located inwardly of padlock body end 24 is a compartment 42 for receiving a battery 43. Communicating with compartment 42 is an entry 44 closed by a removable cap 45. Battery 43 has a positive pole 46 and a negative pole 47 located at respective opposite ends of the battery. Positive battery pole 46 is engaged by a resilient conductive element 48 connected by a wire 49 to a circuit board 50 located adjacent end 23 of padlock body 10.

Referring to FIGS. 1 and 7, negative battery pole 47 is engaged by a conductive element 52 extending from an inner conductive portion 53 of a disc-shaped member 54 having an outer contact portion 55 separated from inner conductive portion 53 by an insulative portion 56. A wire 57 connects inner conductive portion 53 of member 54 to circuit board 50 to ground the battery's negative pole 47. A wire 58 connects outer contact portion 55 to circuit board 50.

As noted above, entry 44 to battery compartment 42 is closed by a removable cap 45 which is externally threaded for engaging an internally threaded sleeve 61 which surrounds entry 44. Both sleeve 61 and cap 45 are composed of electrically insulative material.

Extending integrally inwardly from cap 45 is a stud 60 which, when cap 45 is threadedly engaged with sleeve 61 to close entry 44, engages member 54, pushing it inwardly into battery compartment 42. As previously noted, inner conductive portion 53 and its conductive element 52 engage negative battery pole 47, so that when stud 60 pushes inwardly on member 54, the latter pushes inwardly on battery 43. As battery 43 is pushed inwardly in compartment 42, positive battery pole 46 pushes inwardly against conductive element 48 the periphery of which engages against a spacing element 63 composed of non-conductive, resilient material, which compresses to accommodate the inward movement of battery 43. Spacing element 63 has an opening 64 through which extends wire 49 connecting conductive element 48 with circuit board 50.

Cap 45 is removable from threaded engagement with sleeve 61 in entry 44, by inserting a tool (not shown) into a slot 59 in the outer end of cap 45 (FIG. 2) and employing the tool to unscrew the cap. The outline of slot 59 corresponds to the cross-section of the tool. The tool is also used to screw cap 45 inwardly in entry 44 to the fully closed position for cap 45 shown in FIG. 1.

Removal of cap 45 from entry 44 eliminates the pressure of stud 60 pushing against member 54, and resilient spacing element 63 then expands to maintain conductive element 48 in engagement with positive battery pole 46 and to maintain negative battery pole 47 in engagement with conductive element 52. When cap 45 has been removed from entry 44, outward movement of member 54 through entry 44 is blocked by a C-shaped ring 65 located adjacent the inner end of entry 44.

When cap 45 has been removed from entry 44, and resilient spacing element 63 and conductive element 48 are in their fully expanded positions (not shown in FIG. 1), the distance between conductive element 48 and ring 65 is slightly less than the length of the battery from the tip of pole 46 to the tip of pole 47. Thus there is always some compressive force exerted against resilient spacing element 63 when battery 43 is in compartment 42 due to the condition described in the preceding sentence and to the interposition of element 54 between ring 65 and battery 43; and this is what keeps conductive elements 48 and 52 in contacting engagement with their respective battery poles 46, 47 when cap 45 has been removed.

C-shaped ring 65 is composed of resilient, electrically-conductive material. Referring to FIG. 7, located immediately adjacent C-shaped ring 65 and inwardly thereof in entry 44 is a ring 67 received within a groove 68 in internally threaded sleeve 61. C-shaped ring 65 is inserted into groove 68 by pinching together, e.g., with a needle-nose pliers, the perforate ends 74, 75 of ring 65 (FIG. 8) in a manner conventional to such rings. When ring ends 74, 75 are released, relieving the pinching on ring 65, the resiliency of the ring causes it to expand outwardly in groove 68, and inclined surface 69 of groove 68 cams ring 65 inwardly into close contacting, electrically-conductive engagement with ring 67 which is connected by a wire 70 to circuit board 50 (FIG. 1).

Ring 67 has an opening 72 through which may pass battery 43 for removal of the battery from compartment 42. Ring 65, located immediately outwardly of ring 67, has an opening 73 which is too small for battery 43 to pass through, thereby blocking removal of the battery. Battery 43 can only be removed if ring 65 is first removed from groove 68, and this is accomplished by pinching together the perforate ends 74, 75 of ring 65, in a conventional manner for such rings. Similarly, no replacement battery can be inserted into an empty compartment 42 if ring 65 previously has been inserted within groove 68.

Figure 5:
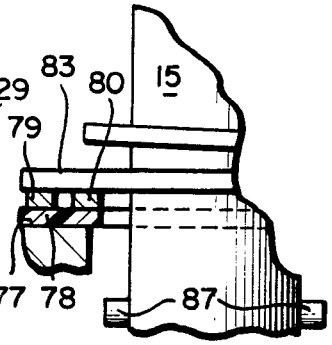
FIG. 5 is a fragmentary sectional view taken along line 5—5 in FIG. 1.

Referring now to FIGS. 1 and 5, surrounding long shackle leg 15 is a first ring 78 composed of electrically insulative material. Ring 78 rests on a ledge 77 formed by one of the laminations 11, and ring 78 is in a stationary disposition relative to long shackle leg 15. Located on the outward-facing surface of ring 78 are a pair of ring-shaped conductors 79, 80 each of which is connected by a respective wire 81, 82 to circuit board 50. Conductors 79, 80 are spaced apart from each other and are electrically insulated from each other by ring 78.

Also disposed around long shackle leg 15 is a second ring 83 composed of electrically conductive material and movably mounted around long shackle leg 15 for movement toward and away from first ring 78. Second ring 83 is engaged by the inner end of a coil spring 84 having an outer end abutting against an overhanging ledge 85 formed by one of the laminations 11. Coil spring 84 normally urges second ring 83 into contact with first ring 78. When the two rings are in contact, second ring 83 electrically connects the two conductors 79, 80 on first ring 78. Coil spring 84, which acts on second ring 83 to urge it inwardly, is weaker than coil spring 35 which acts on shackle leg 15 to urge the leg outwardly when leg 15 is disengaged from latch 30.

Extending radially outwardly from long shackle leg 15 are a pair of aligned pins 87, 87 one of which is disposed on each side of leg 15. Upon disengagement of latch 30 from notches 26, 27 on shackle leg 15, shackle leg 15 is moved outwardly by its coil spring 35. When this occurs, pins 87, 87 engage second ring 83 and move ring 83 outwardly against the urging of its coil spring 84. This breaks the electrical connection between conductors 79 and 80 on ring 78.

As noted above, that portion of short shackle leg 17 adjacent its free end 40 moves through sleeve 21, and this sleeve has an internal groove 89 in which is mounted a conductor ring 90 located inwardly of free leg end 40. Located inwardly of conductor ring 90 is a conductor member 91 mounted on the outer end of a coil spring 92 in turn mounted on a spring guide 93 composed of electrically insulative material and mounted on a ledge 94 formed from a lamination 11.

Coil spring 92 is a conductive element and normally urges member 91 outwardly toward ring 90. A wire 96 attached to spring 92 connects conductor member 91 to circuit board 50, and a wire 95 connects conductor ring 90 to circuit board 50.

Extending outwardly from conductor member 91 is a stud 97 composed of electrically insulative material. Stud 91 extends outwardly through conductor ring 90 and abuts against free end 40 of short shackle leg 17 when the shackle is in its closed position (FIG. 1), and this holds conductor member 91 away from electrical contact with conductor ring 90, against the urging of coil spring 92. The distance between conductor member 91 and conductor ring 90, when the shackle is closed (as shown in FIG. 1) is much less than the distance traveled in an outward direction by free end 40 of short shackle leg 17, is much less than the distance travelled in an outward direction by pins 87, 87 to ring 83 and is much less than the distance travelled by any other part of the shackle, when the shackle moves from its closed to its open position. More particularly, outward movement of the shackle from its closed position (FIG. 1) is determined by ledge 85 which engages the outer end of compressible coil spring 84, thereby limiting outward movement of ring 83 under the urging of pins 87, 87 fixed on long shackle leg 15. Thus, the distance shackle 16 moves outwardly is no greater than the distance between ledge 85 and ring 83 when the shackle is closed minus the axial dimension of compressed coil spring 84.

Located between circuit board 50 and lock mechanism 31 is a transducer 100 for sounding an alarm. Located outwardly of circuit board 50 is a block 101 of electrically insulative, compressible material.

Figure 6:
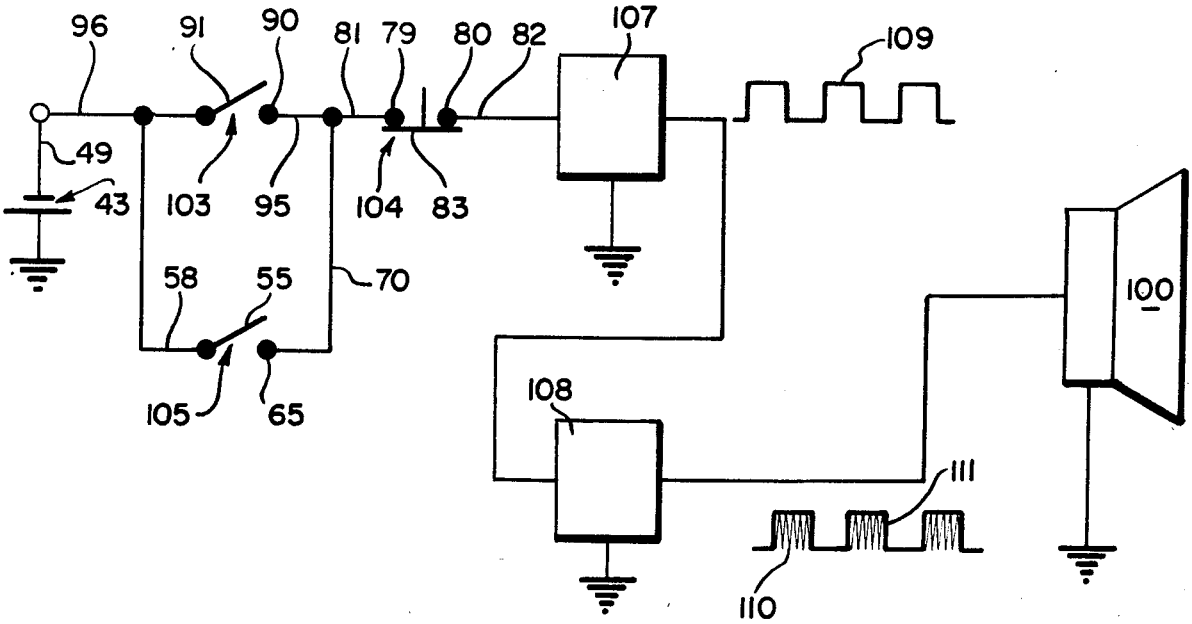
FIG. 6 is a schematic diagram illustrating an electrical circuit for the alarm system in the padlock.

The electrical circuit for the alarm system is illustrated in FIG. 6 and comprises three switches indicated generally at 103, 104 and 105. First switch 103 is located in channel 18, adjacent free end 40 of short shackle leg 17 when the latter is in its closed position. Second switch 104 is located in channel 14 adjacent long shackle leg 15. Third switch 105 is located in entry 44 to battery compartment 42.

First switch 103 is closed when conductor member 91 is urged by coil spring 92 into contact with conductor ring 90, but first switch 103 is normally maintained in an open condition by the abutment of stud 97 against free end 40 of short shackle leg 17, thereby maintaining conductor member 91 out of contact with conductor ring 90.

Second switch 104 is closed when ring 83 electrically connects the two ring shaped conductors 79, 80 on ring 78. Second switch 104 is normally maintained in a closed position by the action of coil spring 84 pushing inwardly against ring 83.

Third switch 105 is closed when outer contact portion 55 on member 54 engages C-shaped ring 65. Third switch 105 is normally maintained in an open condition when cap 45 fully closes entry 44, causing stud 60 to push member 54 inwardly and out of contact with C-shaped ring 65.

Located on circuit board 50 are a pair of astable multivibrators 107, 108. The input to multivibrator 107 is connected to one end of second switch 104, by wire 82. The signal generated in multivibrator 107 is fed into multivibrator 108, through a set/reset input for the latter, where the signal from multivibrator 107 is integrated with the signal generated in multivibrator 108, and the resulting signal is then fed into transducer 100 to sound an alarm.

Electrical energy is conducted from battery 43 to multivibrators 107, 108 to generate respective wave forms therein, when second switch 104 is closed and either first switch 103 or third switch 105 is also closed. If both first and third switches 103, 105 are open while second switch 104 is closed, or if second switch 104 is open while either or both of switches 103 or 105 are closed, no energy will be conducted from battery 43 to multivibrators 107, 108.

The circuitry which makes up each of multivibrators 107, 108 is conventional and need not be disclosed here. Similarly, transducer 100 is of conventional construction and is readily available commercially. Typically, multivibrator 107 generates a square waveform 109 (FIG. 6) of about 4 hertz and multivibrator 108 generates a waveform 110 of about 4 kilohertz, and the two waveforms are integrated with the four kilohertz waveform being internal of the 4 hertz waveform (see 111).

When shackle 16 is moved between its open and closed positions, in either direction, in an authorized manner, the alarm is actuated momentarily as a test of its operativeness. The manner in which this occurs will now be described.

When shackle 16 is unlatched, both shackle legs 15, 17 move outwardly in response to the urging of coil spring 35. At the time outward movement of the shackle begins, second switch 104 is closed and remains closed until pins 87, 87 on long shackle leg 15 engage ring 83 to move ring 83 out of contact with ring 78. However, before this occurs, first switch 103 is closed.

More particularly, outward movement of short shackle leg 17 disengages free end 40 of shackle 17 from stud 97 allowing conductor member 91 to be urged by coil spring 92 into contact with conductor ring 90, and this occurs before pin 87 engages ring 83 around long shackle leg 15. This is because the distance between pins 87, 87 and ring 83 is greater than the distance between member 91 and ring 90, when the shackle is closed. With both switches 103 and 104 closed, an alarm is sounded, and the alarm continues to sound until second switch 104 is subsequently opened by the engagement of outwardly moving pins 87, 87 with ring 83.

Thus the alarm lasts from the time conductor member 91 engages conductor ring 90 until the time when pins 87, 87 engage ring 83, and this is only momentary. Therefore, when the padlock is opened in an authorized manner by inserting a key into key slot 32, and turning the same, a test signal of momentary duration is automatically sounded. A similar test signal of momentary duration is also automatically sounded when the padlock is closed.

More particularly, when shackle 16 is moved inwardly to close the padlock, pins 87, 87 move inwardly. As soon as pins 87, 87 move inwardly of ring 78, ring 83 is urged into engagement with ring 78 by coil spring 84 thereby closing second switch 104. Ring 83 engages ring 78 before free end 40 of short shackle leg 17 engages stud 97 to push the latter downwardly and disengage conductor member 91 from ring 89, to open first switch 103. Therefore, second switch 104 is closed shortly before first switch 103 is opened. With both switches 103 and 104 closed, the alarm sounds, and the alarm continues to sound until first switch 103 is opened. This occurs momentarily after second switch 104 is closed, but the time period when both switches are closed is enough to give a test signal of momentary duration.

First switch 103 is maintained open whenever short shackle leg 17 is in its closed position. Anything that causes short leg 17 to move from its closed to its open position while long shackle leg 15 is in its closed position (illustrated in FIG. 1), will close switch 103 and cause the alarm to sound. This will happen if short leg 17 is severed from long leg 15, e.g. by sawing or cutting shackle 16. Long leg 15 is the only part of the shackle engaged by latch 30, and the attachment of short leg 17 to long leg 15 is what holds short leg 17 in its closed position. When this attachment is severed, short leg 17 is no longer capable of restraining, through its engagement with stud 97, the upward urging of coil spring 92 against conductor member 91 which then moves into engagement with conductor ring 90 to close first switch 103.

The alarm will also sound if short leg 17 is pried or wrenched or otherwise raised up out of channel 18 while long leg 15 remains engaged by latch 30.

The manner in which the battery cap removal alarm sounds will now be described. When battery cap 45 threadedly engages internally-threaded sleeve 61 to close entry 44, stud 60 on cap 45 holds member 54 inwardly out of contact with C-shaped ring 65, to maintain third switch 105 in an open condition. When battery cap 45 is removed, stud 60 no longer constitutes an obstacle for the movement of member 54 in an outward direction toward C-shaped ring 65. Element 54 is urged outwardly toward C-shaped ring 65 by virtue of resilient spacing element 63 urging conductive element 48 outwardly against battery 43 which in turn urges member 54 outwardly until its outer contact portion engages C-shaped ring 65, thereby closing third switch 105. C-shaped ring 65 is connected through conductive ring 67 and wire 70 to normally closed second switch 104. Accordingly, closing third switch 105 connects the battery to the alarm generating circuit, sounding the alarm.

Battery cap 45 can be removed without sounding the alarm merely by first unlocking the padlock in an authorized manner with a key before removing cap 45. This disengages latch 30 from long leg 15 thereby causing long leg 15 to move outwardly within channel 14, disengaging ring 83 from conductors 79, 80 on ring 78, thereby opening second switch 104 before third switch 105 is closed by the removal of cap 45.

Set forth below in the following table is a summary of the effects produced by various combinations of switches in their open or closed position.

| Condition of Switch | | | |
|---|---|---|---|
| First Switch, At Short Shackle Leg | Second Switch, At Long Shackle Leg | Third Switch, at entry to Battery Compartment | Effect |
| Open | Closed | Open | —* |
| Closed | Closed | Open | Alarm |
| Open | Closed | Closed | Alarm |
| Closed | Open | Closed | —** |
| Closed | Closed/Open | Open | Test |
| Closed | Open/Closed | Open | Test |
| Closed | Closed | Closed | Alarm |
| Closed | Open | Open | — |

*normal condition
**battery replacement condition

A battery 43 can be removed from compartment 42 for replacement by removing C-shaped ring 65 and pivoting element 54 on its wires 57, 58 to one side of entry 44, thereby allowing battery 43 to drop outwardly through entry 44. As noted above, ring 67 has an opening which is wide enough to permit battery 43 to pass therethrough while ring 65 has an opening too small for battery 43 to pass through, and therefore must be removed before battery 43 can be removed from compartment 42.

The foregoing detailed description has been given for clearness of understanding only, and no unnecessary limitations should be understood therefrom, as modifications will be obvious to those skilled in the art.

We claim:

1. A padlock with a tamper alarm, said padlock comprising:

a body;

a shackle having a pair of legs;

means mounting said shackle for reciprocal movement relative to said body between a closed first position and an open second position of the shackle when the shackle is in its closed position;

lock means operable to disengage said latch means from said shackle;

alarm means actuable to sound an alarm;

and means, responsive to the movement of said shackle between its first and second position, for automatically actuating said alarm means momentarily as a test of its operativeness.

2. A padlock as recited in claim 1 wherein said movable shackle comprises a long leg and a short leg and said means for actuating said alarm means momentarily comprises:

means for containing a battery;

a first ring surrounding said long shackle leg;

means mounting said first ring in a stationary disposition relative to said long shackle leg;

a pair of conductors on said first ring;

means on the first ring electrically insulating each of said pair of conductors from the other;

means for electrically connecting one conductor on said ring to said battery;

means electrically connecting the other conductor on said ring to said alarm means;

a second ring disposed around said long shackle leg and movably mounted thereon for movement toward and away from the first ring;

means normally urging said second ring into contact with the first ring;

and means on the second ring for electrically connecting the two conductors on the first ring when the two rings are in contact.

3. A padlock as recited in claim 2 and comprising:

means on the long leg of said shackle for engaging said second ring and moving it away from and out of contact with said first ring, to an open position for the second ring, in response to movement of the shackle from its closed to its open position.

4. A padlock as recited in claim 1 and comprising:

a compartment is said body for containing a battery to provide energy for said alarm means;

an entry to said compartment for gaining access to a battery therein;

a removable cap for closing said entry;

and means, responsive to the removal of said cap when the shackle is in its closed position, for actuating said alarm means.

5. A padlock as recited in claim 4 wherein said means for actuating said alarm means in response to the removal of said cap comprises:

an electrical circuit comprising a pair of switch means;

means for maintaining one of said switch means in an open condition when said cap is unremoved;

means for maintaining the other of said switch means in a closed position when said shackle is in its closed position;

said electrical circuit comprising means for connecting said battery to said alarm means to actuate the alarm means, when both of said switch means are closed;

and means responsive to the removal of said cap for closing said one switch means.

6. A padlock as recited in claim 5 and comprising:

means responsive to the movement of said shackle from its closed to its open position for opening said other switch means.

7. A padlock as recited in claim 5 and comprising:

means rendering said alarm means disconnected from said battery when one of said switch means is open.

8. A padlock as recited in claim 4 and comprising:

means, responsive to severance of said shackle when the shackle is in its closed position, for actuating said alarm means.

9. A padlock as recited in claim 4 and comprising:

means, responsive to the movement of the other shackle leg toward said open position thereof while said one leg is engaged by said latch means, for actuating said alarm means.

10. A padlock as recited in claim 1 and comprising:

means, responsive to severance of said shackle when the shackle is in its closed position, for actuating said alarm means.

11. A padlock as recited in claim 1 and comprising:

means, responsive to the movement of the other shackle leg toward said open position thereof while said one leg is engaged by said latch means, for actuating said alarm means.

12. A padlock as recited in claim 1 wherein said means for actuating said alarm means momentarily comprises:

means for containing a battery;

an electrical circuit including first and second switch means;

means for maintaining said first switch means in an open condition and said second switch means in a closed position when said shackle is in its closed position;

said electrical circuit comprising means for connecting said battery to said alarm means to actuate the alarm means, when both of said switch means are closed;

and means, responsive to the movement of said shackle from its closed to its open position, for closing said first switch means and for then opening said second switch means after said first switch means has been closed.

13. A padlock as recited in claim 12 and comprising:

means, responsive to the movement of said shackle from its open to its closed position, for closing said second switch means and for then opening said first switch means after said second switch means has been closed.

14. A padlock as recited in claim 12 wherein said electrical circuit comprises:

means rendering said alarm means disconnected from said battery when one of said switch means is open.

15. A padlock as recited in claim 12 and comprising:

a compartment in said body for containing said battery;

an entry to said compartment for gaining access to a battery therein;

a removable cap for closing said entry;

and means, responsive to the removal of said cap when the shackle is in its closed position, for actuating said alarm means.

16. A padlock as recited in claim 15 wherein said means for actuating said alarm means in response to the removal of said cap comprises:

third switch means in said electrical circuit;

means for maintaining said third switch means in an open condition when said cap is unremoved;

said electrical circuit comprising means for connecting said battery to said alarm means to actuate the alarm means, when both of said second and third switch means are closed;

and means responsive to the removal of said cap for closing said third switch means.

17. A padlock as recited in claim 16 and comprising:

means responsive to the movement of said shackle from its closed to its open position for opening said second switch means.

18. A padlock as recited in claim 16 and comprising:

means rendering said alarm means disconnected from said battery when both of said first and third switch means is open.

19. A padlock as recited in claim 12 wherein said movable shackle comprises a long leg and a short leg and said second switch means comprises:

a first ring surrounding said long shackle leg;

means mounting said first ring in a stationary disposition relative to said long shackle leg;

a pair of conductors on said first ring;

means on the first ring electrically insulating each of said pair of conductors from the other;

means for electrically connecting one conductor on said ring to said battery;

means for electrically connecting the other conductor on said ring to said alarm means;

a second ring disposed around said long shackle leg and movably mounted thereon for movement toward and away from the first ring;

means normally urging said second ring into contact with the first ring;

and means on the second ring for electrically connecting the two conductors on the first ring when the two rings are in contact.

20. A padlock as recited in claim 19 wherein said means for opening said second switch means comprises:

means associated with the long leg of said shackle for engaging said second ring and moving it away from and out of contact with said first ring, to an open position for the second ring, in response to movement of the shackle from its closed to its open position.

21. A padlock as recited in claim 20 and comprising:

first spring means for urging said shackle from its closed to its open position when said latch means is disengaged from the shackle;

said urging means for said second ring comprising second spring means;

said first spring means being stronger than said second spring means.

22. A padlock as recited in claim 12 wherein said movable shackle comprises a long leg and a short leg having a free end, and said first switch means comprises;

a conductor ring located in said body inwardly of said free end of said short shackle leg;

a conductor member located in said body inwardly of said conductor ring;

means for electrically connecting one of (a) said conductor ring and (b) said conductor member to said battery and the other to said second switch means;

means mounting said conductor member for movement toward and away from said conductor ring;

means normally urging said conductor member toward said conductor ring for closing said first switch means;

a non-conductive stud extending outwardly from said conductor member, through said conductor ring and abutting against the free end of the short shackle leg when the shackle is in its closed position, to hold said conductor member away from said conductor ring when the shackle is closed;

the distance between the conductor member and the conductor ring when the shackle is closed being less than the distance traveled in an outward direction by the free end of the short shackle leg when the shackle moves from its closed to its open position.

23. A padlock as recited in claim 22 wherein said second switch means comprises:

a first ring surrounding said long shackle leg;

means mounting said first ring in a stationary disposition relative to said long shackle leg;

a pair of conductors on said first ring;

means on the first ring electrically insulating each of said pair of conductors from the other;

means for electrically connecting one conductor on said ring to said battery;

means electrically connecting the other conductor on said ring to said alarm means;

a second ring disposed around said long shackle leg and movably mounted thereon for movement toward and away from the first ring;

means normally urging said second ring into contact with the first ring;

and means on the second ring for electrically connecting the two conductors on the first ring when the two rings are in contact.

24. A padlock as recited in claim 23 wherein said means for opening said second switch means comprises:

means associated with the long leg of said shackle for engaging said second ring and moving it away from and out of contact with said first ring, to an open position for the second ring, in response to movement of the shackle from its closed to its open position.

25. A padlock as recited in claim 24 wherein:

the distance between (a) said open position of said second ring and (b) the position of said second ring when it contacts the first ring is less than the distance traveled by the free end of the short shackle leg when it moves inwardly from (c) the open position of the shackle to (d) the position at which said free end abuts said non-conductive stud.

26. A padlock as recited in claim 1 wherein said means for momentarily actuating said alarm means comprises:

means for containing a battery;

an electrical circuit including first and second switch means;

means for maintaining said first switch means in a closed position and said second switch means in an open position, when said shackle is in its open position;

said electrical circuit comprising means for connecting said battery to said alarm means to actuate the alarm means, when both of said switch means are closed;

and means, responsive to the movement of said shackle from its open to its closed position, for closing said second switch means and for then opening said first switch means after said second switch means has been closed.

27. A padlock as recited in claim 26 and comprising:

means responsive to the movement of said shackle from its closed to its open position, for closing said first switch means and for then opening said second switch means after said first switch means has been closed;

and means rendering said alarm means disconnected from said battery when one of said switch means is open.

28. A padlock as recited in claim 26 wherein said electrical circuit comprises:

means rendering said alarm means disconnected from said battery when one of said switch means is open.

29. A padlock with a tamper alarm, said padlock comprising:

a body;

a shackle having a pair of legs;

means mounting said shackle for reciprocal movement relative to said body between a closed first position and an open second position of the shackle;

latch means for engaging one leg of said shackle when the shackle is in its closed position;

lock means operable to disengage said latch means from said shackle;

alarm means actuable to sound an alarm;

a compartment in said body for containing a battery to provide energy for said alarm means;

an entry to said compartment for gaining access to a battery therein;

a removable cap for closing said entry;

first contact means between said cap and the location in said compartment for said battery;

ring-shaped second contact means between said first contact means and said cap;

means for electrically connecting one of said contact means to said battery and the other contact means to said alarm means;

means mounting said first contact means for movement between a closed first position, in which the first contact means is in electrical contact with said second contact means for closing a connection between said battery and said alarm means, and an open second position in which said electrical contact is broken;

means associated with said cap for displacing the first contact means to its open second position when the cap is closed;

and means for urging the first contact means to its closed first position in response to removal of said cap;

whereby said alarm means is actuated in response to the removal of said cap when the shackle is in its closed position.

30. A padlock as recited in claim 29 wherein:

said first contact means constitutes the outer portion of a member having an electrically conductive inner portion for engaging said battery and an insulative portion separating said outer and inner portions;

and said means for urging the first contact means to its closed position comprises means for urging said battery toward said cap.

31. A padlock as recited in claim 29 wherein:

said second contact means comprises a pair of conductive rings;

one of said rings being connected to the alarm means and having an opening through which may pass a battery containable in said compartment, for removal of the battery from said compartment;

means removably mounting the other ring in an operative position in which said other ring is in electrical contact with said one ring;

said other ring having an opening too small for said battery to pass through when the other ring is in its operative position, thereby blocking removal of the battery;

said other ring comprising means for effecting said electrical contact with said first contact means when the latter is in its closed first position.

32. A padlock with a tamper alarm, said padlock comprising:

a body;

a shackle having a pair of legs means mounting said shackle for reciprocal movement relative to said body between a closed first position and an open second position of the shackle;

latch means for engaging one leg of said shackle when the shackle is in its closed position;

lock means operable to disengage said latch means from said shackle;

alarm means actuable to sound an alarm;

a compartment in said body for containing a battery to provide energy for said alarm means;

an entry to said compartment for gaining access to a battery therein;

a removable cap for closing said entry;

an electrical circuit comprising a pair of switch means;

means for maintaining one of said switch means in an open condition when said cap is unremoved;

means for maintaining the other of said switch means in a closed position when said shackle is in its closed position;

said electrical circuit comprising means for connecting said battery to said alarm means to actuate the alarm means, when both of said switch means are closed;

said one switch means comprising first contact means between said cap and the location in said compartment for said battery;

ring-shaped second contact means between said first contact means and said cap;

said connecting means comprising means for electrically connecting one of said contact means to said battery and the other contact means to said other switch means;

means mounting said first contact means for movement between a closed first position, in which the first contact means is in electrical contact with said second contact means to close the one switch means, and an open second position in which said electrical contact is broken;

means associated with said cap for displacing the first contact means to its open second position when the cap is closed;

and means for urging the first contact means to its closed first position in response to removal of said cap;

whereby said alarm means is actuated in response to the removal of said cap when the shackle is in the closed position.

33. A padlock as recited in claim 32 wherein:

said first contact means constitutes the outer portion of a member having an electrically conductive inner portion for engaging said battery and an insulative portion separating said outer and inner portions;

and said means for urging the first contact means to its closed position comprising means for urging said battery toward said cap.

34. A padlock as recited in claim 32 wherein:

said second contact means comprises a pair of conductive rings;

one of said rings being connected to the other switch means and having an opening through which may pass a battery containable in said compartment, for removal of the battery from said compartment;

said one switch means comprising means removably mounting the other ring in an operative position in which said other ring is in electrical contact with said one ring;

said other ring having an opening too small for said battery to pass through when the other ring is in its operative position, thereby blocking removal of the battery, said other ring comprising means for effecting said electrical contact with said first contact means when the latter is in its closed first position.

35. A padlock with a tamper alarm, said padlock being for use with a battery having a pair of poles each at a respective opposite end of the battery, said padlock comprising:

a body;

a shackle having a pair of legs;

means mounting said shackle for reciprocal movement relative to said body between a closed first position and an open second position of the shackle;

latch means for engaging one leg of said shackle when the shackle is in its closed position;

lock means operable to disengage said latch means from said shackle;

alarm means actuable to sound an alarm;

a compartment in said body for containing a battery to provide energy for said alarm means;

an entry to said compartment for gaining access to a battery therein;

a removable cap for closing said entry;

means, responsive to the removal of said cap when the shackle is in its closed position, for actuating said alarm means;

a pair of movable battery-engaging elements each comprising means for engaging a respective pole of said battery;

each of said battery-engaging elements being located adjacent a respective pole of said battery when the battery is in said compartment;

means associated with said cap for urging one of said battery-engaging elements toward said battery to maintain the battery in contact with both of said battery-engaging elements when said entry is closed by said cap;

means for urging the other of said battery engaging elements toward said battery to maintain the battery in contact with both of said battery-engaging elements when said cap is removed;

and means for limiting the movement of said one battery-engaging element away from said battery when the cap is removed;

said urging means for said other battery-engaging element comprising means for limiting movement of the other battery-engaging element away from the battery when said one battery engaging element is urged toward the battery.

36. A padlock with a tamper alarm, said padlock comprising:

a body;

a shackle having a long leg and a short leg having a free end;

means mounting said shackle for reciprocal movement relative to said body between a closed first position and an open second position of the shackle;

latch means for engaging said long leg of said shackle when the shackle is in its closed position;

lock means operable to disengage said latch means from said shackle;

alarm means actuable to sound an alarm;

means in said body for containing a battery to provide energy for said alarm means;

a conductor ring located inwardly of said free end of said short shackle leg;

a conductor member located in said body inwardly of said conductor ring;

means for electrically connecting one of (a) said conductor ring and (b) said conductor member to a battery contained in said body and the other to said alarm means;

means mounting said conductor member for movement toward and away from said conductor ring;

means normally urging said conductor member toward said conductor ring for closing a connection between said battery and said alarm means;

and a non-conductive stud extending outwardly from said conductor member, through said conductor ring and abutting against the free end of the short shackle leg when the shackle is in its closed position, to hold said conductor member away from said conductor ring when the shackle is closed;

the distance between the conductor member and the conductor ring when the shackle is closed being less than the distance traveled in an outward direction by the free end of the short shackle leg when the shackle moves from its closed to its open position;

whereby said alarm means is actuated in response to movement of the short leg toward its open position while the long leg is engaged by the latch means.

* * * * *